US009539807B2

(12) United States Patent
Sato et al.

(10) Patent No.: US 9,539,807 B2
(45) Date of Patent: Jan. 10, 2017

(54) LIQUID EJECTION APPARATUS, PRINT METHOD, AND PRINT SYSTEM

(71) Applicant: SEIKO EPSON CORPORATION, Tokyo (JP)

(72) Inventors: Akito Sato, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/774,397

(22) Filed: Feb. 22, 2013

(65) Prior Publication Data

US 2013/0222449 A1 Aug. 29, 2013

(30) Foreign Application Priority Data

Feb. 23, 2012 (JP) ..... 2012-037110

(51) Int. Cl.

| | |
|---|---|
| ***B41J 2/15*** | (2006.01) |
| ***B41J 2/07*** | (2006.01) |
| ***B41J 2/21*** | (2006.01) |
| ***B41J 19/14*** | (2006.01) |

(52) U.S. Cl.

CPC ..... *B41J 2/07* (2013.01); *B41J 2/2132* (2013.01); *B41J 19/142* (2013.01)

(58) Field of Classification Search

CPC ..... B41J 2/2132; B41J 2/145; B41J 19/142

See application file for complete search history.

(56) References Cited

U.S. PATENT DOCUMENTS

| | | | | |
|---|---|---|---|---|
| 5,044,796 | A | 9/1991 | Lund | |
| 6,863,367 | B2 * | 3/2005 | Hamamoto et al. | 347/23 |
| 7,500,727 | B2 * | 3/2009 | Takahashi | 347/12 |
| 8,011,756 | B2 * | 9/2011 | Ike | B41J 2/2107 347/43 |
| 8,342,646 | B2 * | 1/2013 | Mizutani | B41J 2/2103 347/40 |
| 8,500,251 | B2 * | 8/2013 | Kubo | 347/58 |
| 2009/0251499 | A1 | 10/2009 | Santo et al. | |
| 2013/0194333 | A1 | 8/2013 | Ito et al. | |
| 2014/0347415 | A1 | 11/2014 | Ito et al. | |

FOREIGN PATENT DOCUMENTS

| | | | |
|---|---|---|---|
| JP | 60-107975 | A | 6/1985 |
| JP | 02-233275 | A | 9/1990 |
| JP | 07-237346 | A | 9/1995 |
| JP | 2003-260789 | A | 9/2003 |
| JP | 2008-173835 | A | 7/2008 |
| JP | 2009-241281 | A | 10/2009 |
| JP | 2011-207147 | A | 10/2011 |

* cited by examiner

*Primary Examiner* — Lamson Nguyen

(74) *Attorney, Agent, or Firm* — Global IP Counselors, LLP

(57) ABSTRACT

Banding has been prone to take place as regards black ink. Nozzle columns for color inks are arranged side by side in a direction in which a medium is conveyed, and are allocated to each color, and an amount of the medium equivalent to the length of the nozzle columns of each of the colors among the nozzle columns for the color inks is fed, to print on a forward path and return path from the nozzle columns for the color inks. As such, by repeatedly printing 100% of the total number of dots on every single scan for the color inks, the corresponding print region is covered.

10 Claims, 10 Drawing Sheets

| | |
|---|---|
| 1 | 1 |
| 2 | 2 |
| 3 | 3 |
| 4 | 4 |
| 5 | 5 |
| 6 | 6 |
| 7 | 7 |
| 8 | 8 |
| 1 | 9 |
| 2 | 10 |
| 3 | 11 |
| 4 | 12 |
| 5 | 13 |
| 6 | 14 |
| 7 | 15 |
| 8 | 16 |
| 1 | 17 |
| 2 | 18 |
| 3 | 19 |
| 4 | 20 |
| 5 | 21 |
| 6 | 22 |
| 7 | 23 |
| 8 | 24 |

HEAD IMAGE 2

Fig. 2

| OUTPUT | CMY | Bk | Bk COLUMN |
|---|---|---|---|
| FIRST PASS | C1 | Bk 1 | Bk3 COLUMN |
| SECOND PASS | C2 M1 | -- | -- |
| THIRD PASS | C3 M2 Y1 | Bk -2,3 | Bk2 COLUMN<br>Bk3 COLUMN |
| FOURTH PASS | C4 M3 Y2 | -- | -- |
| FIFTH PASS | C5 M4 Y3 | Bk -4,5 | Bk2 COLUMN<br>Bk3 COLUMN |

Fig. 7

LIQUID EJECTION APPARATUS, PRINT METHOD, AND PRINT SYSTEM

CROSS-REFERENCE TO RELATED APPLICATIONS

This application claims priority to Japanese Patent Application No. 2012-037110 filed on Feb. 23, 2012. The entire disclosure of Japanese Patent Application No. 2012-037110 is hereby incorporated herein by reference.

BACKGROUND

Technical Field

The present invention relates to a liquid ejection apparatus for ejecting ink droplets, as well as to a print method and a print system; in particular, the invention relates to a vertical array liquid ejection apparatus in which nozzle columns for color inks are allocated for each color and are arranged side by side in a direction in which a medium is conveyed, as well as to a print method and print system.

Background Technology

There is known a so-called vertical array liquid ejection apparatus having nozzle columns for a plurality of color inks and a nozzle column for black ink, the nozzle columns for the color inks and the nozzle column for the black ink being disposed side by side in a direction orthogonal to a direction in which a medium is conveyed, and the nozzle columns for the color inks being allocated for each color and being arranged side by side in the direction in which the medium is conveyed. Patent Document 1 discloses such a vertical array liquid ejection apparatus.

During printing in the vertical array liquid ejection apparatus disclosed in Patent Document 1, an amount of the medium commensurate with the nozzle column for the color inks is fed, and in a single scan, 100% of a total number of dots is printed for each of the color inks. On the other hand, as regards the black ink, the nozzle column for the black ink is divided into groups for each of the colors of the color inks; 50% of the total number of dots is printed in a single scan, and 100% of the total number of dots is printed in two scans of reciprocating motion.

There are three of the color inks, namely, CMY (where cyan is denoted by C, magenta is denoted by M, and yellow is denoted by Y), and therefore a control is carried out as regards the black ink so that 50% of the printing is carried out together with the C, and subsequently 50% of the printing is carried out together with the M, while no printing is (believed to be) carried out during the printing of the Y.

Japanese Laid-open Patent Publication No. 7-237346 (Patent Document 1) is an example of the related art.

SUMMARY

Problems to be Solved by the Invention

Well-known reciprocating motion printing (bidirectional ("BiD") printing) is carried out for the black ink to complete printing in a certain range of the medium in the conveyance direction. For this reason, in a region to which the print range is connected in the direction of the medium, there has been more likely to be banding, which is when white streaks appear due to a deviation in the amount of feed or the like. Additionally, in adopting the vertical array, controlling the printing has not been easy, especially as regards the black ink in comparison to the printing of the color inks.

Means Used to Solve the Above-Mentioned Problems

The invention is a liquid ejection apparatus for ejecting ink droplets, wherein the liquid ejection apparatus includes nozzle columns for a plurality of color inks and a nozzle column for black ink, the nozzle columns for the color inks and the nozzle column for the black ink being disposed side by side in a direction orthogonal to a direction in which a medium is conveyed, and wherein a configuration is adopted in which the nozzle columns for the color inks are allocated for each of the colors and are arranged side by side in the direction in which the medium is conveyed and an amount of medium equivalent to the length of the nozzle column for each of the colors within the nozzle columns for the color inks is fed, to print on a forward path and a return path from the nozzle columns for the color inks, and in which the printing with the black ink is controlled in nozzle column units adjacent to the nozzle columns for the color inks, and partial overlay printing is carried out so as to fill in the total [number of] dots in an earlier print step and later print step as regards the print region of a part to which the print region would be connected in the earlier print step and the later print step.

In the configuration described above, the nozzle columns for the color inks are allocated for each of the colors and are arranged side by side in the direction in which the medium is conveyed, and an amount of medium equivalent to the length of the nozzle column for each of the colors within the nozzle columns for the color inks is fed, to print on a forward path and a return path from the nozzle columns for the color inks. As such, by repeatedly printing 100% of the total number of dots on every single scan for the color inks, the corresponding print region is covered.

On the other hand, for the black ink, printing is controlled by nozzle column units adjacent to the nozzle columns for the color inks, and partial overlay printing is carried out so as to fill in the total dots in an earlier print step and later print step as regards the print region of a part to which the print region would be connected in the earlier print step and the later print step. This prevents so-called banding from taking place, because regions that overlap in the two instances of printing in the earlier step and the later step are created at the portion to which the print region is connected.

Advantageous Effects of the Invention

According to the invention, printing is easy to control and banding, too, is less like to take place, even with a vertical array liquid ejection apparatus. It is also possible to provide a print method and print system that give rise to similar effects.

BRIEF DESCRIPTION OF THE DRAWINGS

Referring now to the attached drawings which form a part of this original disclosure:

FIG. 2 is a drawing illustrating an image of nozzle columns on a head;

FIG. 7 is a drawing illustrating the relationship between passes and groups of nozzle columns, during printing;

DETAILED DESCRIPTION OF EXEMPLARY EMBODIMENTS

Hereinafter, embodiments of the invention will be described with reference to the accompanying drawings.

First Embodiment

Figure 1:
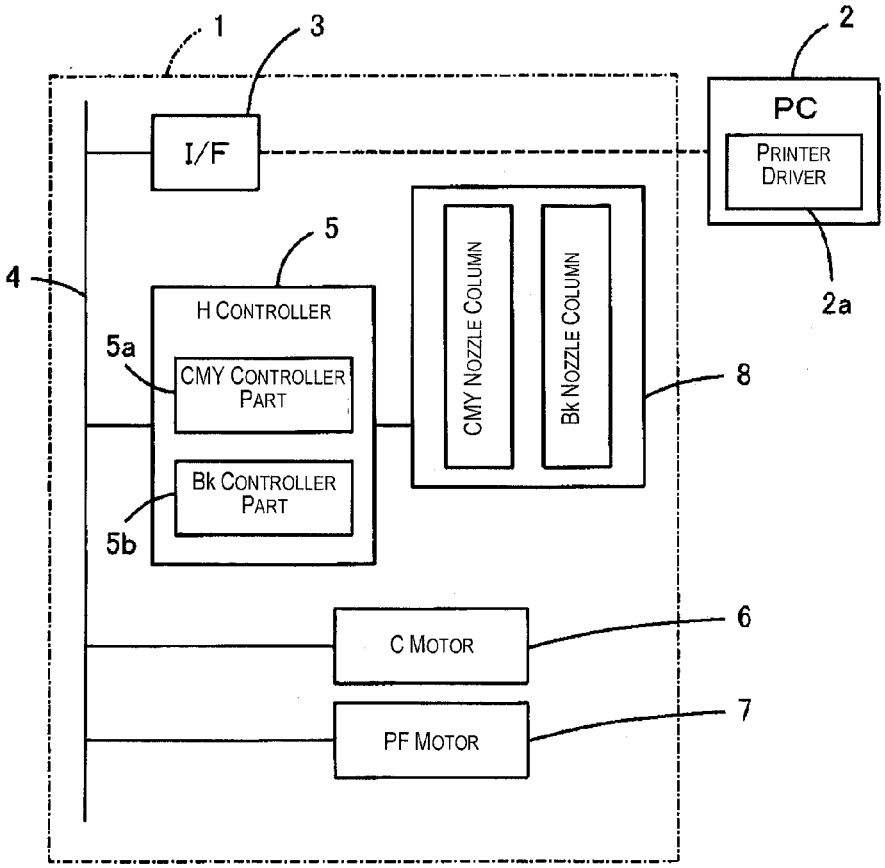
FIG. 1 is a block diagram of a print system including a liquid ejection apparatus and a print control apparatus (a personal computer (PC))

FIG. 1 illustrates a block diagram of a liquid ejection apparatus and print control apparatus (PC) constituting a print system as in one embodiment of the invention. In FIG. 1, a liquid ejection apparatus 1 for ejecting ink droplets is connected to an external personal computer (PC) 2 over an interface 3. The interface 3 is connected to a bus 4; also connected to the same bus 4 are a head controller 5, a carriage motor 6, and a paper feed motor 7. The head controller 5 is provided with a controller part 5*a* for CMY, which are color inks, and a controller part 5*b* for Bk, which is black ink. A head 8, which is provided with a nozzle column for the color inks and with a nozzle column for black ink, is connected to the head controller 5, where the nozzle column for the color inks is controlled by the controller part 5*a* for CMY and the nozzle column for black ink is controlled by the controller part 5*b* for Bk. An operating system is running in the PC 2, and a printer driver 2*a* is incorporated therein as a partial functionality thereof. The printer driver 2*a* generates and outputs print data for controlling printing by the liquid ejection apparatus 1, on the basis of print source data that is outputted from an application.

FIG. 2 illustrates an image of the nozzle columns of the head 8. In FIG. 2, the left side is the nozzle column for the color inks, and the right side is the nozzle column for the black ink. The color inks are the three colors CMY, and are allocated to Y, M, and C, in the stated order, in three regions, namely, a leading end, a middle, and trailing end, respectively, from above. A print medium is conveyed along the direction of the nozzle columns. The nozzle column for the black ink is provided in parallel with the nozzle columns for YMC. Although there are stated to be eight nozzles each for Y, M, and C and 24 nozzles for Bk, this has been simplified in the light of the limitations of drawing. In this manner, the head 8 has the nozzle columns for the plurality of color inks and the nozzle column for the black ink, and the nozzle columns for the color inks and the nozzle column for the black ink are disposed side by side in a direction orthogonal to a direction in which the medium is conveyed; the nozzle columns for the color inks are arranged side by side in the direction in which the medium is conveyed, and are allocated to each of the colors. In the present embodiment, the nozzle columns for the color inks have substantially the same number of nozzles allocated to each of the plurality of colors.

Figure 3:
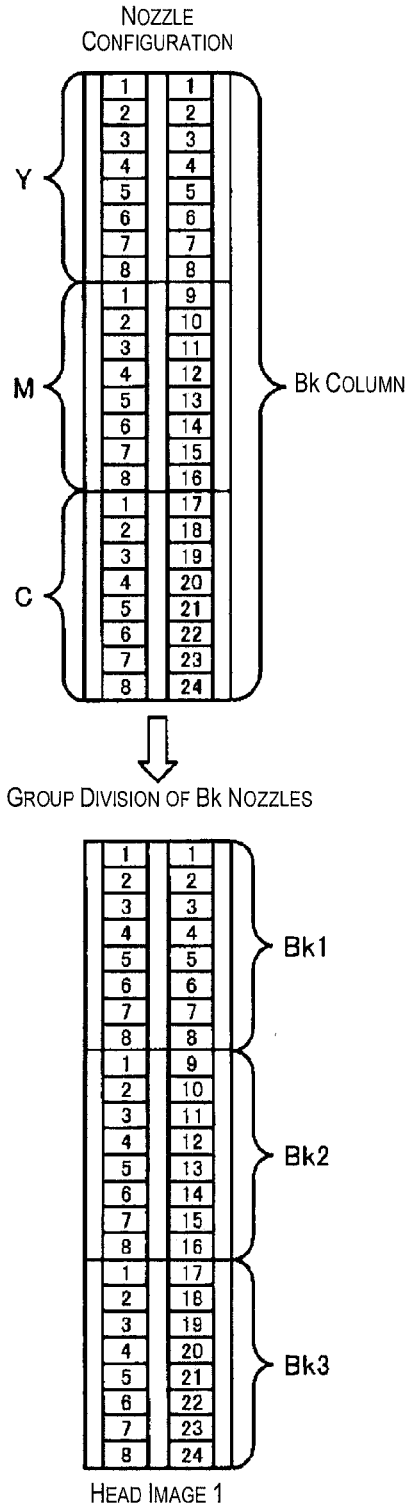
FIG. 3 is a drawing illustrating an image of group divisions for color inks and black ink.

FIG. 3 illustrates an image of the group divisions of the color inks and the black ink. Fundamentally, color inks of respectively different colors are allocated to the nozzle columns for color, and thus, the nozzle columns become a Y nozzle column, an M nozzle column, and a C nozzle column; the one column to which the black ink is allocated serves as a simple Bk column. In order to facilitate print control, however, the Bk column also has group divisions into a Bk1 column, a Bk2 column, and a Bk3 column, so as to correspond to the color inks of each of the colors. Thus, when there are three colors of the color inks, the nozzle column for the black ink is given group divisions by being segmented into the three regions adjacent to the nozzle columns for each of the colors, and printing is carried out for each of the regions, as shall be described below.

Figure 4:
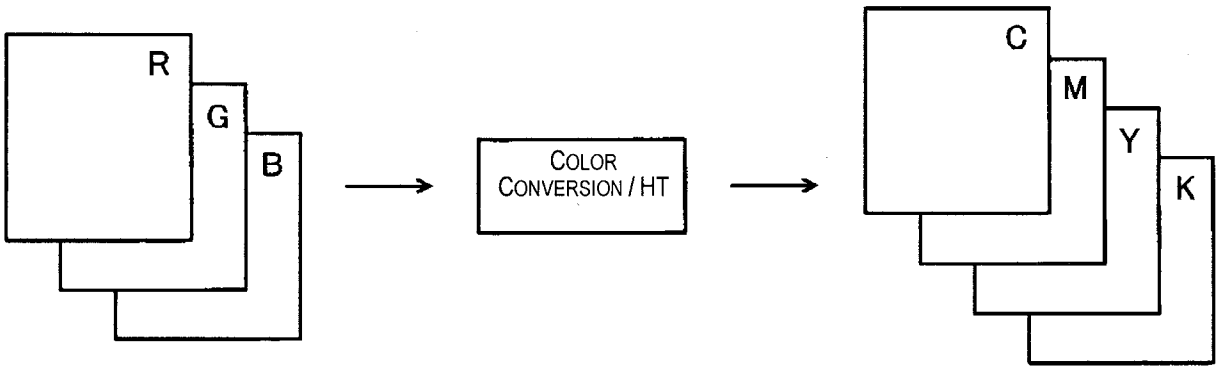
FIG. 4 is a drawing illustrating steps for converting print data.

The description shall now relate to the operation of the present embodiment including the above-described configuration. FIG. 4 is a drawing illustrating steps for converting print data. When some variety of printing is carried out from an application in the PC 2, print source data is generated from the application and outputted to the printer driver 2*a*. There are regarded as being a variety of formats for the print source data, which undergoes some variety of conversion to become bit map data (can be directly and without alteration, or conversion is possible) including three planes of red, green, and blue (RGB). The print driver 2*a* assumes RGB bit map data, and executes color conversion to CMYK as well as halftone processing so as to correspond to turning on/off the ejection of liquid droplets at each of the nozzles. After halftoning, either bit map data in the four planes of C, M, Y, and K matched to the nozzle density or data equivalent thereto is generated. The printer driver 2*a* determines as appropriate the amount of the medium to be fed and the nozzle column(s) to be used in printing, and generates raster data (rasterization data) needed to actually drive each of the nozzles of the head 8.

In the case of the present embodiment, the printer driver 2*a* clips out raster data that corresponds to and is needed for the actual driving of the nozzle columns, from the bit map data of the four planes of CMYK, and outputs same to the liquid ejection apparatus 1 as raster data via the interface 3. As such, raster data for the color inks and raster data for the black ink are generated and accumulated within a range that corresponds to the nozzle columns for all of the color inks, and raster data that corresponds to the above-described nozzle columns being made to print is supplied.

Figure 5:
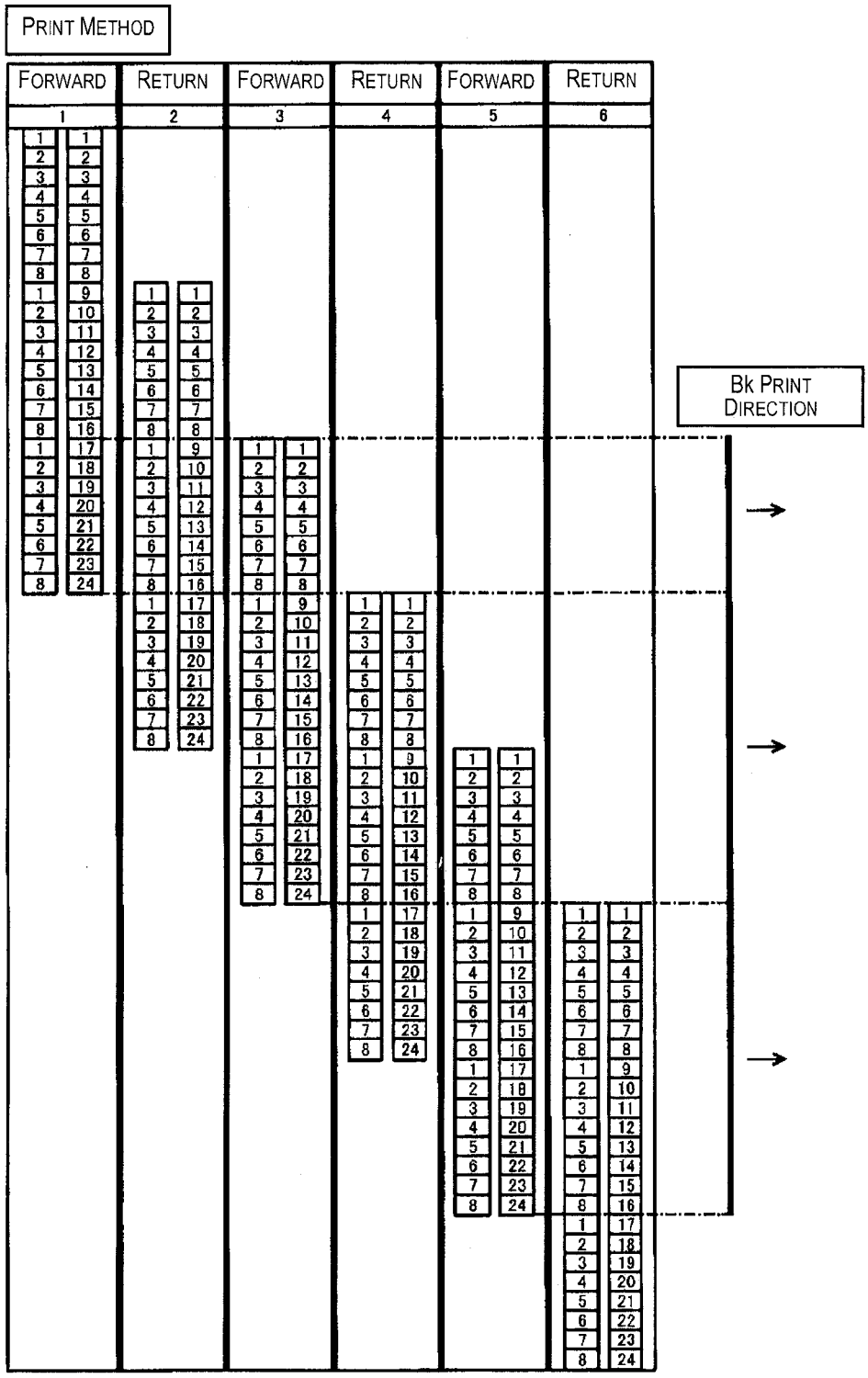
FIG. 5 is a drawing illustrating a print method in a forward path and a return path.

FIG. 5 illustrates a print method on a forward path and a return path. The print medium is conveyed by the paper feed motor 7 in the upward direction in the depiction, and therefore the illustrated image is such that the head 8 descends gradually in a relative fashion. The head 8 is driven reciprocatingly (forward and back) by the carriage motor 6 along a secondary direction of the print medium, where a single scan forward and back serves as a forward path and return path, respectively. The print medium, as illustrated in FIG. 5, is conveyed by an amount equivalent to the length of the nozzle columns of each of the colors. That is, for one scan in the forward path or in the return path, the medium is fed in an amount equivalent to the length of a nozzle column of each of the colors within the nozzle columns for the color inks. For the sake of convenience, what is listed in the depiction as the forward path, the return path, the forward path, the return path, the forward path, and the return path shall be called pass 1, pass 2, pass 3, pass 4, pass 5, pass 6, and so forth.

Figure 6:
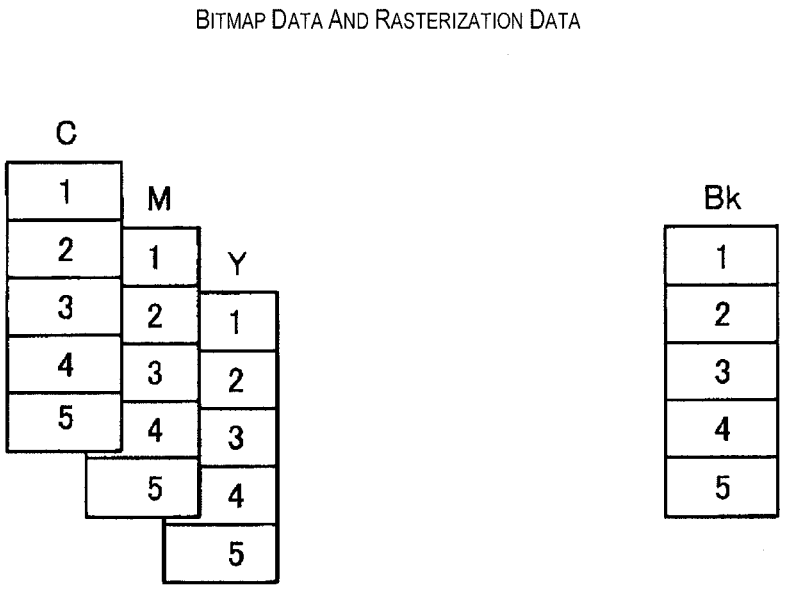
FIG. 6 is a drawing illustrating CMYK bit map data that is based on the nozzle column lengths.

FIG. 6 illustrates the CMYK bit map data that is based on the nozzle column length. Though the bit map data for C is originally generated for each of the nozzles, an amount equivalent to the C column is printed at one time in a single scan, and thus this amount shall be called the C1 bit map data. Similarly, because an amount equivalent to the C column is printed at one time in a subsequent scan, this amount is called the C2 bit map data. In a similar fashion, the bit map data for M, Y, and Bk is also sliced into sections, which shall be associated with M1, M2, and so forth, with Y1, Y2, and so forth, and with Bk1, Bk2, and so forth, in order to be indicative of the corresponding regions. This output relationship is also equivalent to the raster data in the printer driver 2*a*.

FIG. 7 is a drawing illustrating the relationship between passes and groups of nozzle columns, during printing. The description shall carry on referring to FIGS. 7 and 5 in identifying sites where printing is to be carried out. With reference to FIG. 5, the columns that enter the print region at the first pass are solely the C column and Bk3 column. In the illustration in FIG. 7, the C1 bit map data and the Bk1 bit map data illustrated in FIG. 6 are being printed. The right column of the table in FIG. 7 illustrates the Bk column at which the Bk bit map data is to be printed. It shall be readily understood that the C column prints the C1 of the color inks, but as regards the Bk bit map data, the question of whether it is the Bk1 column, the Bk2 column, or the Bk3 column that is to be used is illustrated. Herein, the Bk3 column is used for the Bk1 of the first pass. The Bk3 column prints 100% of a total number of dots, and printing in this print region is completed.

The second pass is the return path, but in this second pass, the columns that enter the print region are the C column, the M column, the Bk2 column, and the Bk3 column. As regards the color inks, the C1 is already printed, and therefore the C2 is printed in the C column, and the M1 is printed in the M column. In all of the columns, a total number of dots is printed in a single scan, and thus 100% of the printing is carried out. As regards the black ink, on the other hand, the Bk2 column and the Bk3 column have entered the print region, and printing was not carried out in the first pass in the region which the Bk3 column now faces. In the present embodiment, however, printing is not carried out because it is on the return path. BiD deviation thus does not take place.

In other words, there is printing on the forward and return paths from the nozzle columns for the color inks, while printing from the nozzle columns for the black ink happens only during operation in a predestined direction within the forward- and return-path operations; also, during a single scan in the forward path or in the return path, the nozzle columns for the black ink are completing printing of the same scanning range. The third pass will be the forward path, and the C column, the M column, and the Y column, which are the nozzle columns of all of the color inks, will face the print region; the C3, M2, and Y1 bit map data are printed as respectively illustrated in FIG. 7. At this time, too, 100% of the total number of dots is printed, and printing of each of the colors in each of the regions is completed.

As regards the black ink, too, the Bk1 column, the Bk2 column, and the Bk3 column all face the print region. However, the region for Bk1 had completed printing with the Bk3 column in the first pass. For this reason, printing in the third pass is completed only by the Bk2 column and the Bk3 column, which now face the regions for Bk2 and Bk3 that have yet to be printed. In the illustration in FIG. 7, as well, the Bk2 column and the Bk3 column are used together for the third pass.

Thereafter, all of the nozzle columns of the color inks (the C column, the M column, and the Y column) and all of the nozzle columns for the black ink (the Bk1 column, the Bk2 column, and the Bk3 column) all face the print region. Also, for the color inks, all of the nozzle columns are used on the forward path and the return path, as is the bit map data for the corresponding regions, to print the color inks. For the black ink, however, the region that has not been printed by the Bk2 column and the Bk3 column is completed, only on the forward path, by printing 100% of the total number of dots on every scan.

Thereafter, as regards the black ink, the Bk2 column and the Bk3 column carry on being printed only on the forward path. In this manner, the nozzle columns for the black ink will carry out printing only in the end region (the Bk3 column) on the initial forward path, and thereafter on the forward path carry out printing only in the middle (the Bk2 column) and the trailing end region (the Bk3 column). It would also be possible, however, to alter the control to thereby change which region is used. For example, the required print region could still be covered even by using the Bk1 column and the Bk2 column on only the forward path starting at the third pass. In this sense, at an intermediate position that excludes the start time and the end time, the nozzle columns for the black ink would print using the nozzles in a range amounting to two colors of the nozzle columns for the color inks on only the forward path or on only the return path; more specifically, the nozzle columns for the black ink would not carry out printing on the initial forward path, and thereafter would carry out printing in only the lead region and middle region on the forward path.

Second Embodiment

In the embodiment described above, 100% of the total number of dots was carried out in a single scan in the print region for the black ink. Fundamentally printing on only the forward path enhances the print quality, since BiD deviation does not take place. However, it would still be sometimes possible for banding to take place in the print region of each of the forward paths. For this reason, in the present embodiment, partial overlay printing is carried out at some parts.

Figure 8:
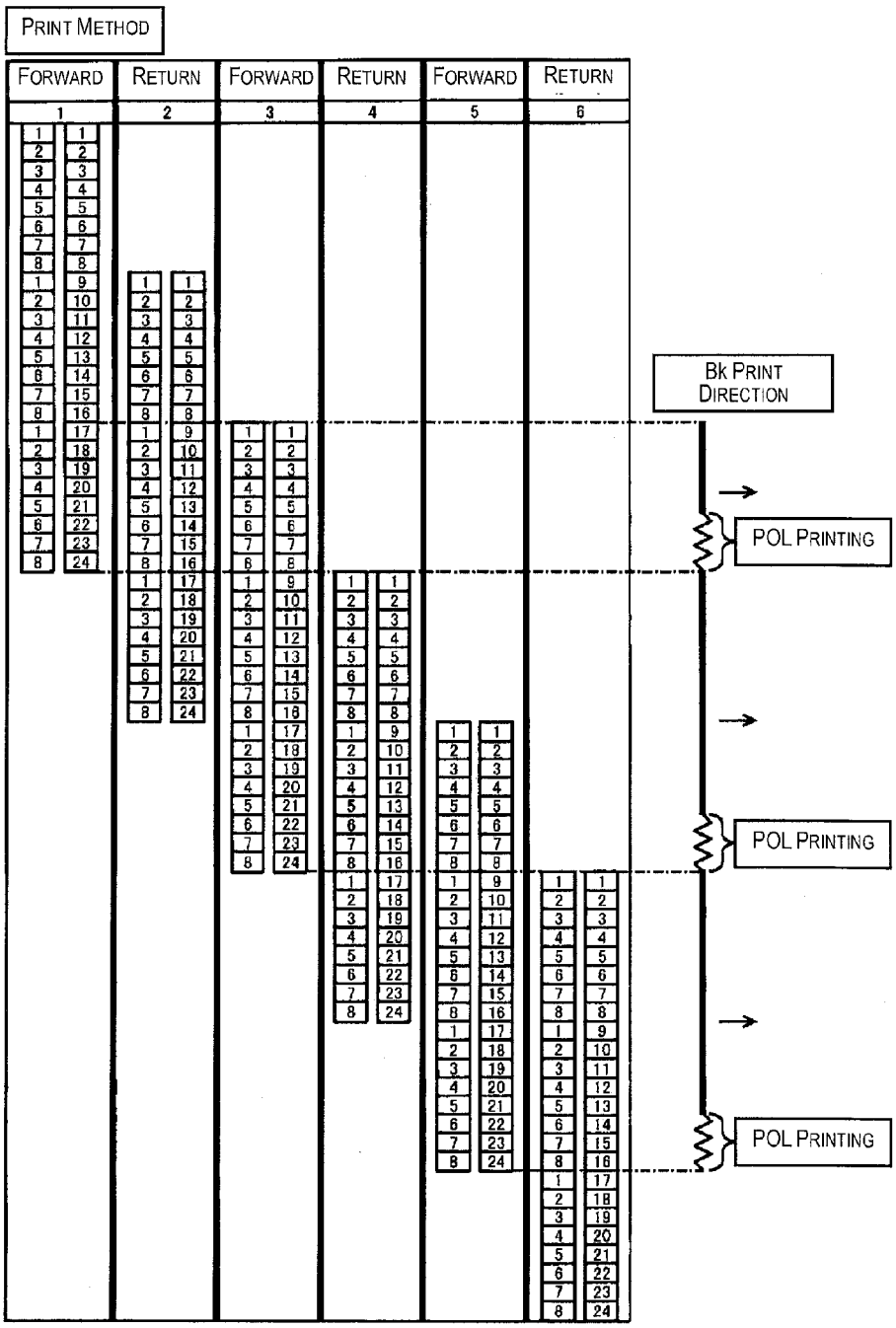
FIG. 8 is a drawing illustrating a print method on a forward path and a return path.

Similarly with respect to FIG. 5, FIG. 8 is a drawing illustrating a print method on the forward path and the return path. However, in the case illustrated in FIG. 8, overlay printing is carried out on the first pass and third pass and on the third pass and fifth pass at end parts of the print region for the black ink (end parts based on the direction in which the medium is conveyed). Rather than having the overlay printing in all of the rasters, the overlay printing is carried out only in a number of rasters amounting to the end parts, and thus the printing is called partial overlay (POL) printing. The term "overlay printing" is a designation for the act of printing all of the dots of one raster in two or more print steps, so that dots of an even-numbered digit within one raster are printed in a prior print step and the unprinted dots of an even-numbered digit are printed in a subsequent print step. That is, the total number of dots are filled in in an earlier print step and later print step as regards the print region in one part to which the print region would be connected in the earlier print step and later print step. It shall be readily understood that it is also possible either not to print an odd-numbered digit, or to address dots of an even-numbered digit with a raster of an even-numbered row and to address dots of an odd-numbered digit with a raster of an odd-numbered row. It would further be possible to change the manner in which the dots printed at each of the steps are combined, so as to have two-dot intervals or three-dot intervals. That is, in the partial overlay printing, the dots of an even-numbered digit or an odd-numbered digit in each of the rasters need not be printed in a prior step, but rather the dots of the same even-numbered digit or the same odd-numbered digit, which were unprinted in the prior step, would then be printed in a subsequent step.

Figure 9:
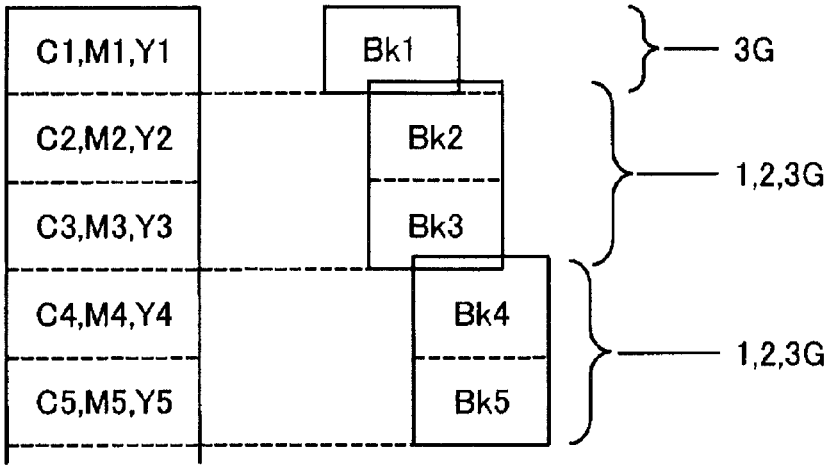
FIG. 9 is a drawing illustrating the relationship between nozzles being used because partial overlay is carried out.

FIG. 9 is a drawing illustrating the relationship between nozzles being used because partial overlay is carried out. The present embodiment is identical with respect to the prior embodiment as regards the color inks, and thus a description thereof has been omitted. A point of commonality with the prior embodiment is that the printing of the black ink happens only on the forward path, but a point of difference resides in the print region being printed. The region of the last several rasters in the Bk1 bit map data on the first pass does not print an even-numbered digit of dots on the first pass. On the third pass, an even-numbered digit of dots of the region of the last several unprinted rasters in the Bk1 bit map data is printed using the Bk1 column. An even-numbered digit of dots is not printed for the last several rasters in the print region on this scan, i.e., for the last several rasters of the Bk3 bit map data.

That is, all of the groups of the Bk1 column, the Bk2 column, and the Bk3 column are used on the third pass. However, for the Bk1 column, it is not that all of the nozzles are used, but rather there is a limitation to the last several rasters only; conversely, for the Bk3 column, 100% printing is not carried out for the nozzles corresponding to several rasters that would be printed using the Bk1 column. In this manner, the overlay printing is carried out in a predetermined range in the conveyance direction, in a region to which the print region for every forward path or return path is connected in the printing with the black ink. Also, with the exception of the portion where the partial overlay printing is being carried out, the nozzle columns for the black ink will print using the nozzles of a range amounting to two colors of the nozzle columns for the color inks, on only the forward path or the return path, at an intermediate position that excludes the start time and end time.

Third Embodiment

In the embodiments described above, fundamentally, printing is carried out on only the forward path to thereby cause BiD deviation not to take place. However, only for a vertical array head of the present embodiment being used to eliminate banding by carrying out partial overlay printing, it is not necessary to print only on the forward path.

Figure 10:
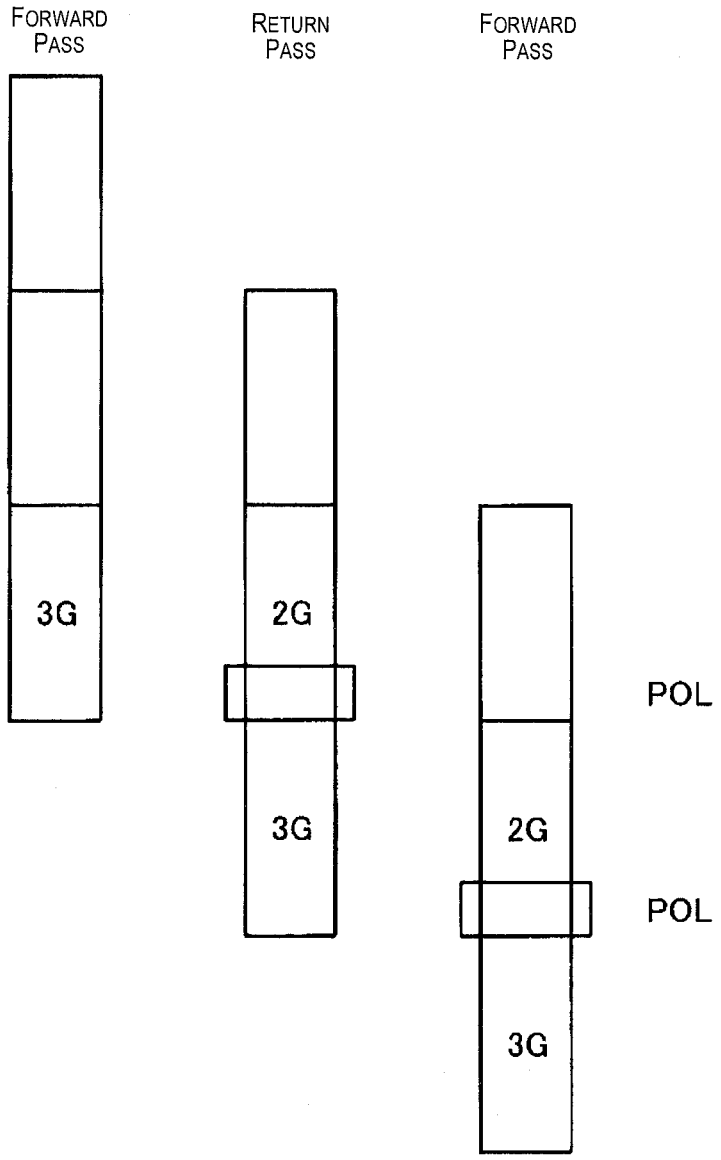
FIG. 10 is a drawing illustrating the relationship between the partial overlay and the nozzle columns being used.

FIG. 10 is a drawing illustrating the relationship between the partial overlay and the nozzle columns being used, when printing happens on the forward path and the return path (BiD printing). FIG. 10 illustrates the first pass, the second pass, and the third pass, starting from the left, and these are equivalent to the forward path, the return path, and the forward path, respectively. Printing with black ink is carried out on all forward paths and all return paths. More specifically, it is the print region for Bk1 that the Bk3 column faces on the first pass, but on the last several rasters in the Bk3 column, an even-numbered digit of dots is not printed. On the second pass, which is a return path, it is the Bk2 column which faces the several rasters that did not print on the first pass, and thus the nozzles of the Bk2 column are used to fill in the even-numbered digit of unprinted dots. On the other hand, the status at the Bk3 column is that the last several rasters do not print an even-numbered digit of dots. Thus, with the exception of the portion where the partial overlay printing is carried out, the nozzle columns for the black ink will print using the nozzles of a range amounting to one color of the nozzle columns for the color inks, on each of the forward path and the return path. In so doing, although there is no relationship with the problem of BiD deviation, banding in the vertical array head can be eliminated.

Thus, the nozzle columns for the color inks are arranged side by side in the direction in which the medium is conveyed, and are allocated to each of the colors, and an amount of the medium equivalent to the length of the nozzle columns of each of the colors among the nozzle columns for the color inks is fed, to print on the forward path and return path from the nozzle columns for the color inks. As such, by repeatedly printing 100% of the total number of dots on every single scan for the color inks, the corresponding print region is covered. For the black ink, printing is controlled by nozzle column units adjacent to the nozzle columns for the color inks, and partial overlay printing is carried out so as to fill in the total dots in an earlier print step and later print step as regards the print region of a part to which the print region would be connected in the earlier print step and the later print step. This prevents banding from taking place, because regions that overlap in the two instances of printing in the earlier step and the later step are created at the portion to which the print region is connected. In the embodiment described above, the generation of the raster data was carried out by the printer driver 2*a*, but it would also be possible to carry out an equivalent functionality in the interior of the liquid ejection apparatus 1. Further, a conversion program can also be provided to a cloud within the Internet.

It shall be readily understood that the invention is not to be limited to the embodiments above. It shall be appreciated by those skilled in the art that:

- the act of applying those members, configurations, and the like disclosed in the embodiments described above which can be substituted with each other, and altering the combinations thereof as appropriate;
- the act of substituting and applying, as appropriate, members, configurations, and the like which, though not disclosed in the embodiments described above, are known in the art and can be substituted with the members, configurations, and the like disclosed in the embodiments described above, and altering the combinations thereof; and
- the act of substituting and applying, as appropriate, members, configurations, and the like which, though not disclosed in the embodiments described above, could be hypothesized on the basis of the known art and the like by a person skilled in the art to be alternatives for the members, configurations, and the like disclosed in the embodiments described above, and altering the combinations thereof;

are intended to be disclosed as one embodiment of the invention.

What is claimed is:

1. A print apparatus for printing on a print medium, comprising:

- a print head;
- a control unit for causing the print head to move in a scanning direction, and for causing the print medium to be conveyed in an intersecting direction that intersects relative to the scanning direction; and
- an ejection control unit;
- the print head being provided with:
- a color nozzle column including color nozzle groups for each color, the color nozzle column being arranged in a single line along the intersecting direction and being configured to eject color inks of a plurality of colors; and a black ink nozzle column which is disposed in parallel with the color nozzle column in the intersecting direction in a position corresponding to the color nozzle column arranged in the single line along the intersecting direction and from which black ink is ejected, a length of the black ink nozzle column in the intersecting direction being the same as a length of the color nozzle column in the intersecting direction, wherein the black ink nozzle column is segmented into nozzle groups of the same number as the number of groups in the nozzle groups for the color inks;

the control unit causing the print medium to be conveyed in a feed amount equivalent to the length, in the intersecting direction, of any one color nozzle group from among the color nozzle column, and the control unit causing one scan, either a forward path scan or a return path scan, of the print head to be executed every time the print medium is conveyed; and the ejection control unit ejecting the color inks from the color nozzle column on both the forward path scan and the return path scan of the print head, and causing the black ink to be ejected from the black ink nozzle column on only one scan, either the forward path scan or the return path scan, of the print head.

2. The print apparatus as set forth in claim 1, wherein the control unit causes the black ink to be ejected from one nozzle group among the nozzle column for the black ink, on only one scan, either the forward path scan or the return path scan, of the head.

3. The print apparatus as set forth in claim 1, wherein during intermediate scanning, which excludes an initial scan and during a final scan during printing, the control unit ejects the black ink from two nozzle groups from among the black ink nozzle column on only one scan, either the forward path scan or the return path scan, of the print head.

4. The print apparatus as set forth in claim 1, wherein when there are three colors of the color inks and the nozzle column for the black ink are segmented into three nozzle groups, the nozzle column for the black ink do not carry out printing on the initial forward path scan, and thereafter on a front path scan carry out printing at only the leading and middle nozzle groups from among the three nozzle groups.

5. The print apparatus as set forth in claim 1, wherein on either the forward path scan or the return path scan of the head and in ejection through a single scan, the control unit causes there to be formed dots of black ink that are to be formed within a region intended for printing, in the feed amount of the print medium.

6. The print apparatus as set forth in claim 1, wherein on either the forward path scan or the return path scan of the head and in ejection through two or more scans, the control unit causes there to be formed dots of black ink that are to be formed in at least an end part of a region intended for printing, in the feed amount of the print medium.

7. The print apparatus as set forth in claim 6, wherein in a case where dots of black ink are to be formed by ejection through two or more scans at the end part, the control unit causes an even-numbered digit or odd-numbered digit of dots, from within the region intended for printing, not to be printed on one of the scans, and causes the same even-numbered digit or the same odd-numbered digit of dots, that was previously not formed, to be formed on another scan.

8. The print apparatus as set forth in claim 1, wherein the nozzle groups for the color inks have substantially the same number of nozzles allocated for each of the colors.

9. A print method for printing using a print apparatus for printing on a print medium, wherein the print apparatus is provided with: a color nozzle column including nozzle groups for each color, the color nozzle column being arranged in a single line along an intersecting direction that intersects relative to a scanning direction in which a print head of the print apparatus is moved, and being configured to eject color inks of a plurality of colors; and a black ink nozzle column which is disposed in parallel with the color nozzle column in the intersecting direction in a position corresponding to the color nozzle column arranged in the single line along the intersecting direction and from which black ink is ejected, a length of the black ink nozzle column in the intersecting direction being the same as a length of the color nozzle column in the intersecting direction, wherein the black ink nozzle column is segmented into nozzle groups of the same number as the number of groups in the nozzle groups for the color inks;

the print method further including conveying the print medium in a feed amount equivalent to the length, in the intersecting direction, of any one color nozzle group from among the color nozzle column, and executing one scan, either a forward path scan or a return path scan, of the print head every time the print medium is conveyed; and ejecting the color inks from the color nozzle column on both the forward path scan and the return path scan of the print head, and ejecting the black ink from the black ink nozzle column on only one scan, either the forward path scan or the return path scan, of the head.

10. A print system comprising a print apparatus for printing on a print medium, wherein the print apparatus is provided with: a color nozzle column including nozzle groups for each color, the color nozzle column being arranged in a single line along an intersecting direction that intersects relative to a scanning direction in which a print head of the print apparatus is moved, and being configured to eject color inks of a plurality of colors; and a black ink nozzle column which is disposed in parallel with the color nozzle column in the intersecting direction in a position corresponding to the color nozzle column arranged in the single line along the intersecting direction and from which black ink is ejected, a length of the black ink nozzle column in the intersecting direction being the same as a length of the color nozzle column in the intersecting direction, wherein the black ink nozzle column is are segmented into nozzle groups of the same number as the number of groups in the nozzle groups for the color inks; the print system also comprising a print control apparatus for controlling the print apparatus and causing same to print;

wherein the print control system generates raster data for the color inks and raster data for the black ink in a range corresponding to all of the nozzle column for the color inks, and transmits to the print apparatus the raster data corresponding to the nozzle column, for the purpose of:

in the print apparatus, conveying the print medium in a feed amount equivalent to the length, in the intersecting direction, of any one color nozzle group from among the color nozzle column, and executing one scan, either a forward path scan or a return path scan, of the print head every time the print medium is conveyed; and ejecting the color inks from the color nozzle column on both the forward path scan and the return path scan of the print head, and ejecting the black ink from the black ink nozzle column on only one scan, either the forward path scan or the return path scan, of the head.

* * * * *